US007647657B2

(12) United States Patent
Delfs

(10) Patent No.: US 7,647,657 B2
(45) Date of Patent: Jan. 19, 2010

(54) DOMED COMFORTER

(75) Inventor: Juliette M Delfs, Seattle, WA (US)

(73) Assignee: Pacific Coast Feather Co., Seattle, WA (US)

( * ) Notice: Subject to any disclaimer, the term of this patent is extended or adjusted under 35 U.S.C. 154(b) by 210 days.

(21) Appl. No.: 11/673,165

(22) Filed: Feb. 9, 2007

(65) Prior Publication Data

US 2008/0189857 A1 Aug. 14, 2008

(51) Int. Cl.
*A47G 9/02* (2006.01)

(52) U.S. Cl. ..... 5/482; 5/486; 112/420; 112/427

(58) Field of Classification Search ..... 5/482, 5/486, 502, 950; 112/420–422, 427, 440, 112/441

See application file for complete search history.

(56) References Cited

U.S. PATENT DOCUMENTS 2,725,927 A * 12/1955 Feinerman ..... 112/427
4,748,703 A * 6/1988 Emi et al. ..... 5/502
5,044,032 A * 9/1991 Tesch ..... 5/502
5,528,781 A * 6/1996 Suzuki et al. ..... 5/502
5,720,058 A * 2/1998 Hollander et al. ..... 5/502
5,943,974 A * 8/1999 Hoag ..... 112/475.01
6,301,730 B1 * 10/2001 Delfs et al. ..... 5/502

FOREIGN PATENT DOCUMENTS

GB 2159050 A * 11/1985

* cited by examiner

*Primary Examiner*—Michael Trettel
(74) *Attorney, Agent, or Firm*—Jensen & Puntigam, P.S.

(57) ABSTRACT

The comforter includes a core portion which includes upper and lower fabric layers with lines of stitching connecting the upper and lower fabric layers and filling within the volumes of the core portion defined thereby. Border portions are attached to the head and foot ends of the core portion, wherein the top edge of the core portion is gathered and the head border portion sewn thereto. The width of the top edge of the core portion is approximately 20-75% wider ungathered than when gathered and sewn to the head border portion. The lower edge of the core portion is approximately 0-50% wider ungathered than when gathered and sewn to the foot border portion. Side border portions are secured to the sides of the core portion and to the opposing ends of the head and foot border portions.

10 Claims, 3 Drawing Sheets

DOMED COMFORTER

TECHNICAL FIELD

This invention relates generally to comforters, and more specifically to a comforter having a particular core portion configuration and arrangement.

BACKGROUND OF THE INVENTION

Comforters are a well-known bedding product widely used and favored by consumers throughout the world, in various configurations and structural arrangements. For instance, while comforters do vary to some extent, they all have the advantage of producing a high degree of warmth with relatively little weight. The lofty appearance of most comforters is also highly attractive to users.

Comforters do have some disadvantages, however. While relatively lightweight, comforters tend to become closely arranged over the user or users in their particular existing positions on the bed. A change in the position of one or more of the users will usually result in a change in the arrangement of the comforter on the users, which can affect their comfort. It would be desirable, therefore, for a comforter to maintain its physical arrangement relative to the users, when the users move beneath the comforter.

SUMMARY

Accordingly, a comforter is disclosed herein, comprising: a core portion, having head and foot ends and side edges, the core portion including upper and lower fabric layers, with lines of stitching connecting the upper and lower fabric layers and filling within the volumes of the core portion defined by the lines of stitching; and a head border portion attached to the top edge of the core portion, wherein the top edge of the core portion is gathered and sewn during manufacture of the comforter to a head border portion, such that the width of the top edge of the core portion is 20-75% wider when the top edge is ungathered prior to being sewn to the head border portion than when the top edge is gathered and sewn to the head border portion.

Further, a process for making a comforter is disclosed herein, comprising the steps of: making a core portion of the comforter which includes upper and lower fabric layers with lines of stitching connecting the upper and lower layers and with filling material positioned within the volumes of the core portion as defined by the lines of stitching, wherein the lines of stitching and the filling are accomplished prior to attachment of a head border portion or after said attachment; and attaching a head border portion to a top edge of the core portion, wherein the top edge of the core portion is gathered prior to attaching the head border portion, wherein the top edge of the core portion is approximately 20-75% wider ungathered than when gathered and attached to the core portion and wherein the head border portion is filled with filling material prior to or following attachment thereof to the core portion.

BEST MODE FOR CARRYING OUT THE INVENTION

Figure 1:
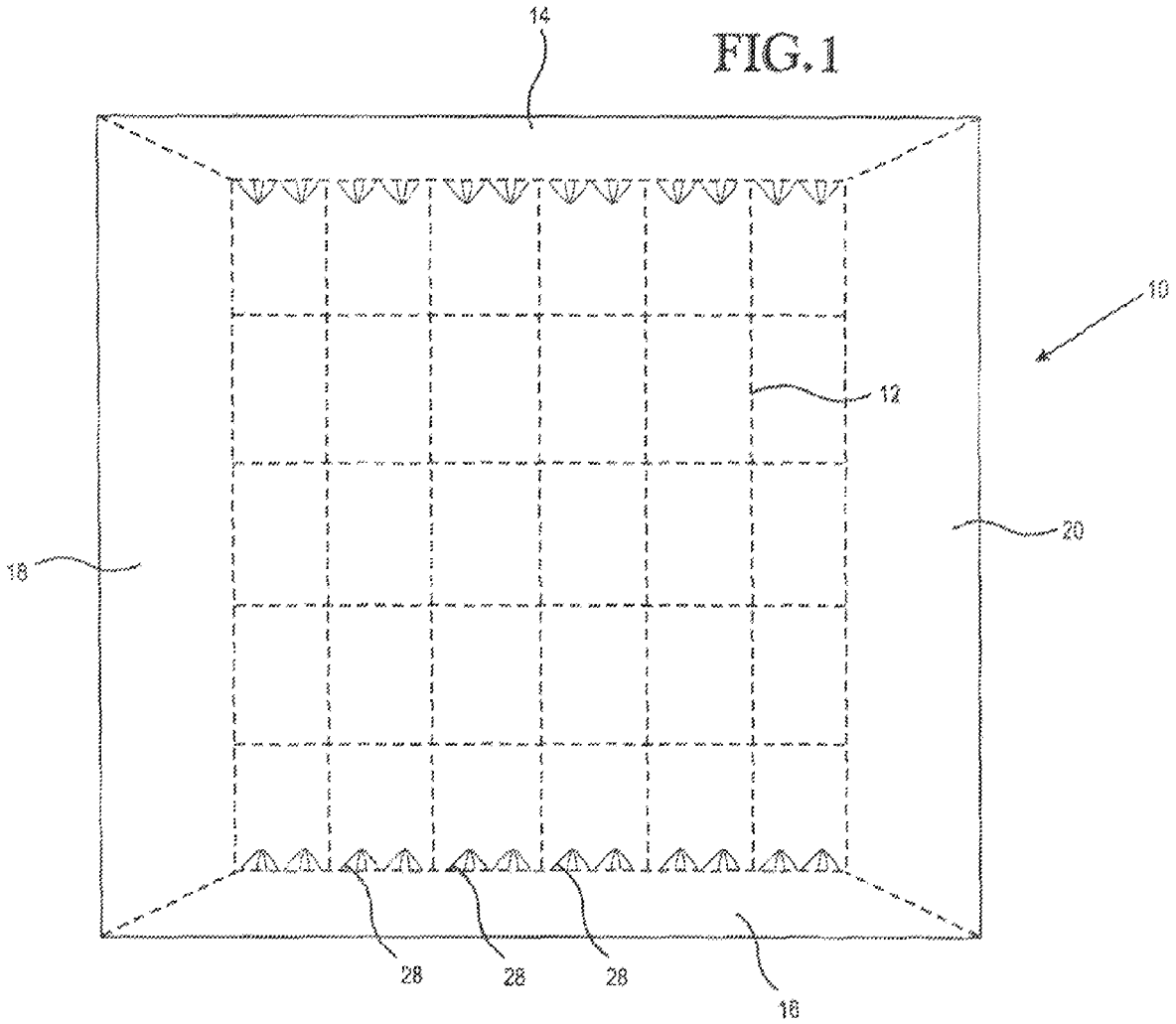
FIG. 1 is a top view of the completed comforter of one embodiment, including a core portion and attached border portions.
Figure 2:
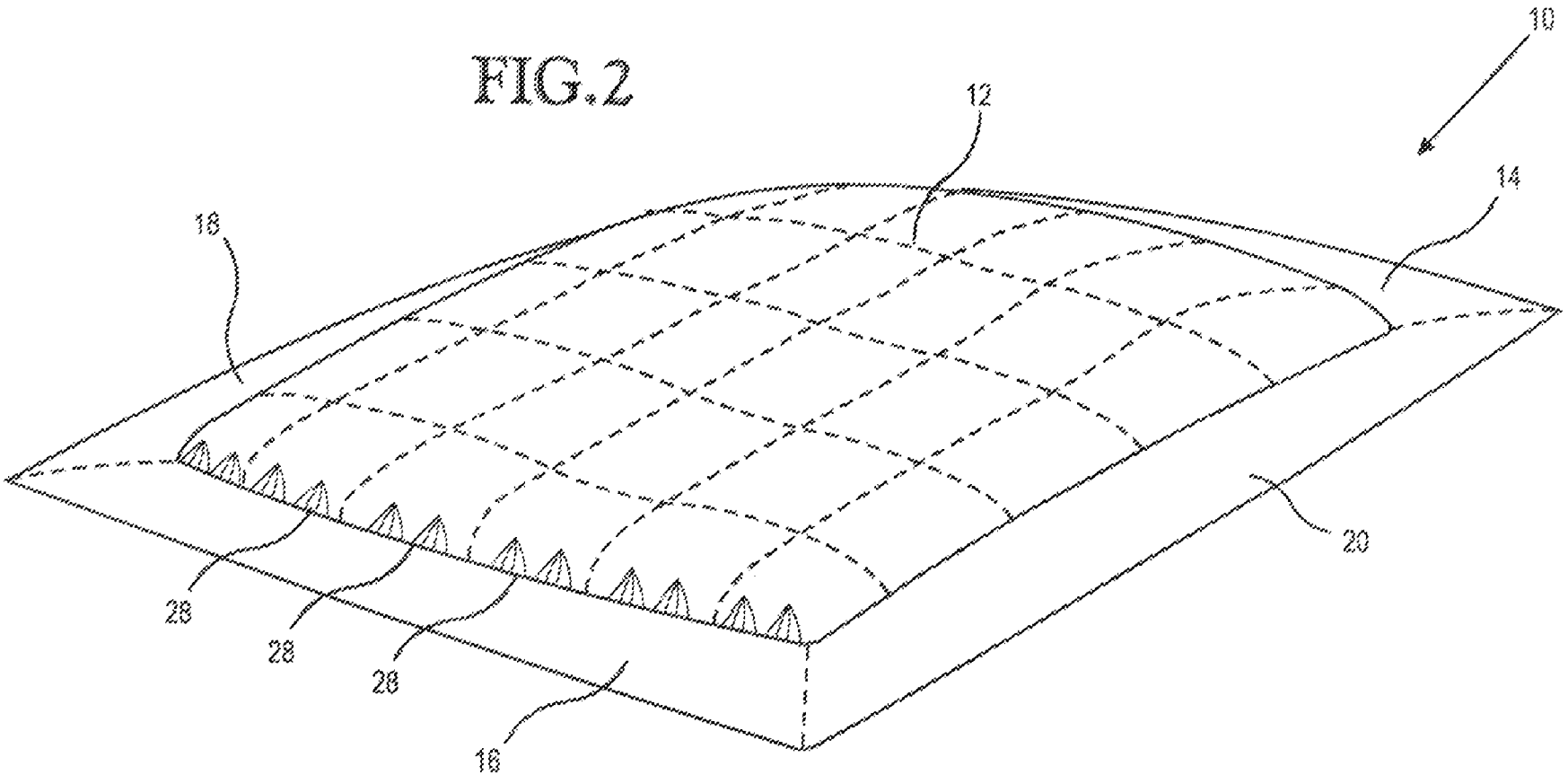
FIG. 2 is a perspective view of the completed comforter of FIG. 1.
Figure 3:
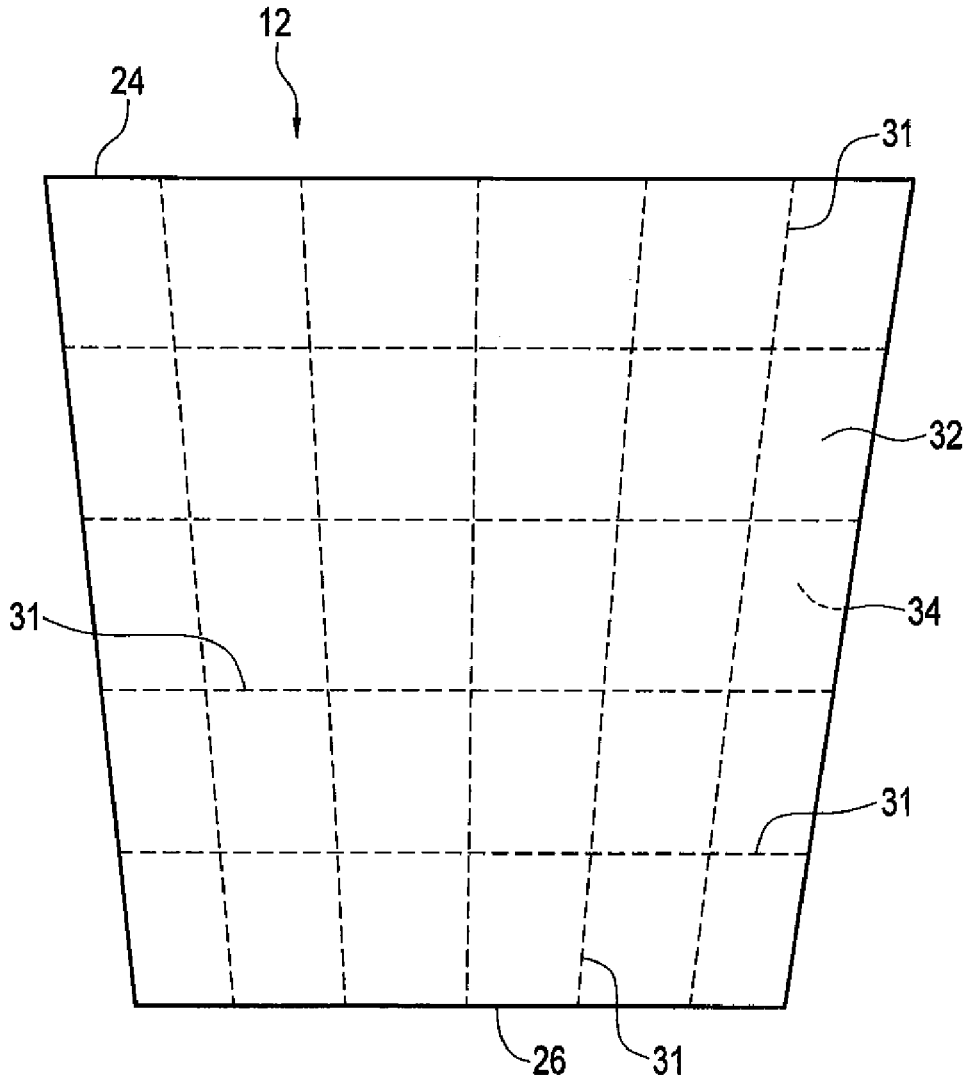
FIG. 3 is a top view of the core portion of the comforter prior to the attachment of the border portions.
Figure 4:
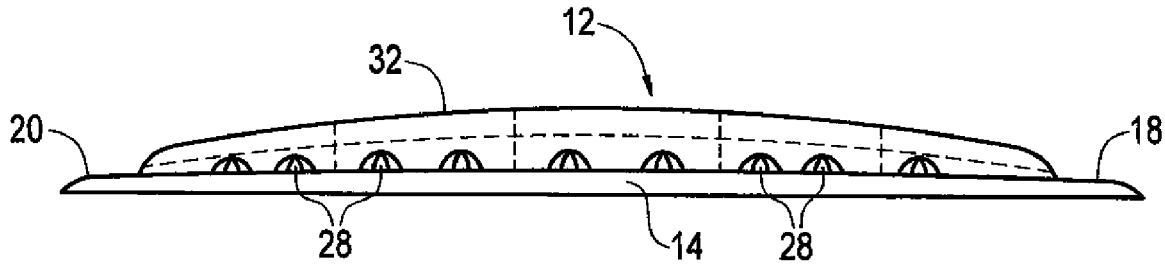
FIG. 4 is a head end elevational view of the comforter of FIG. 1.

FIGS. 1 and 2 show the final manufactured form of the present comforter 10. Comforter 10 includes a core portion 12 bounded by a top or head border portion 14, a bottom or foot border portion 16 and two side border portions 18 and 20. The core portion 12 prior to the attachment of the border portions is shown in FIG. 3, referred to as the unbordered core portion. In the embodiment shown, the width of the top edge 24 of the unbordered core 12 is approximately 1.45 times the resulting width of the top edge of the core portion 12 when the head border portion 14 is attached thereto. The width of the lower edge 26 of the unbordered core portion 12 is approximately 1.1 times the width of the lower edge when the foot border portion 16 is attached to the core portion.

The decrease in width between the unbordered core portion and the bordered core portion is accomplished during the manufacturing process by first gathering or pleating the top edge and lower edge of the core portion and then attaching the gathered/pleated edge by sewing to the head and foot border portions, respectively. These gathers or pleats, shown generally at 28, are positioned at intervals across the edges of the core portion 12 and result in a "domed" or lifted appearance for the comforter in its completed state. While in the embodiment shown, the top edge 24 of core portion 12 has more gathers or pleats and hence a greater domed effect in the completed comforter than of lower edge 26, they could be the same.

More generally than in the specific embodiment described above, the unbordered top edge 24 of core portion 12 will be 20%-75% wider than the bordered top edge after attachment of head border 14, while the unbordered lower edge will be up to 50% wider than the bordered lower edge. Hence, while the upper edge will always have some number of gathers/pleats to create a domed effect in the upper region of the comforter, it is possible that the lower edge will have the same width between unbordered and bordered arrangements, i.e. no gathers or pleats.

The core portion 12 comprises two identical fabric section 32 and 34. The fabric sections 32 and 34 are configured so that the completed comforter covers the desired mattress size on which the comforter is to be used, including the conventional sizes of twin, full, queen and king sizes. The core portion of the completed comforter (after gathering and attachment of the border portions) can be either approximately the size of the top of the mattress, or somewhat wider (up to 20 inches) than the top of the mattress.

The two fabric sections 32 and 34 are stitched together along lines of stitching 31 to form sewn-through boxes, as shown. Other sewn-through configurations/patterns can be used. The peripheral edges of the fabric sections 32 and 34 are secured to form the core portion 12, and filling is typically positioned into the core portion (pre-filled) prior to forming the sewn-through boxes with lines of stitching 31. The filling thus remains in the boxes defined by the lines of stitching 31 during use. The stitching and filling could be done after attachment of the border portions. The boxes could also be formed by baffle members as well. When the core portion 12 is complete, prior to gathering of the top and lower edges and attachment of the border portions, it will have generally the appearance of FIG. 3, somewhat wedge-shaped, with the top edge 24 being wider than the lower edge 26.

The border portions, which are made of fabric and stitched around their peripheries, are then attached to the edges of the core portion 12. The top and bottom border portions 14, 16 are each approximately nine inches wide in the embodiment shown, while the side border portion 18 and 20 are approximately 15 inches wide. These dimensions, however, can vary. The corners of the border portions, i.e. where the side border portions meet the top and bottom border portions, are angled or mitered as shown. They could also be square or have other joining configurations. The border portions are then attached to the core portion 12 with, as indicated above, the head and foot border portions being sewn to the gathered top and bottom edges of the core portion, in such a manner that the top and bottom edges have the same width and are dimensioned to fit the specified mattress size. The side border portions are sewn to the side edges of the core portion in conventional fashion.

The border portions are then filled with filling material, such as feathers, down, polyester material or some combination thereof. Alternatively, the border portions could be prefilled. Typically, but not necessarily, small cross lines of stitching, each line being approximately 1½ inches long, are made within each border, connecting the two pieces of fabric material forming the border portions. The cross sewn-through tacks are approximately 10 inches apart and centered in all the border portions. They begin approximately even with the edges of the core portion. The cross lines are to help reduce the migration of fill. Other stitching patterns could be used, such as boxes, diamonds, etc., or there could be no stitching in the border portions.

While the embodiment shown includes top and bottom border portions as well as two side border portions, it should be understood that only the top and bottom border portions are necessary.

The result of the above construction is a comforter with a domed configuration, in which the center of the comforter is higher than the edges thereof when the comforter is positioned on a mattress, thereby providing a spatial region between the comforter and the mattress, which allows the user to change position underneath the comforter without significantly affecting the position of the comforter on the user. This increases the comfort provided by the comforter in use, particularly when more than one person is covered by the comforter. Movement of one or both of the users thus can occur without the comforter moving significantly as a result, which does occur with traditional comforters. The head border region mitigates any drafts which may occur as the users shift position.

Although a preferred embodiment of the invention has been disclosed here for the purposes of illustration, it should be understood that various changes, modifications and substitutions may be incorporated in the embodiment without departing from the spirit of the invention, which is defined by the claims which follow. The term "gathered" as used above and in the claims includes various forms of gathering material to decrease the top and lower edge dimensions, including pleating, folding, gathering or other similar steps of arranging the edges of the core portion.

What is claimed is:

1. A comforter, comprising:

a core portion, having head and foot ends and side edges, the core portion including upper and lower fabric layers of substantially the same size, wit lines of stitching connecting the upper and lower fabric layers and filling within the volumes of the core portion defined by the lines of stitching; and a head border portion attached to the top edge of the core portion, wherein the top edge of the core portion, which includes the top edges of both the upper and lower fabric layers, is gathered and sewn during manufacture of the comforter to a head border portion, such that the width of the top edge of the core portion is 20-75% wider when the top edge is ungathered prior to being sewn to the head border portion than when the top edge is gathered and sewn to the head border portion.

2. The comforter of claim 1, wherein the lower edge of the core portion is gathered and sewn to a foot border portion such that the width of the lower edge of the core portion is approximately 0-50% wider when the lower edge is ungathered prior to being sewn to the foot border portion than when the lower edge is gathered and sewn to the foot border portion.

3. The comforter of claim 1, wherein the top edge of the core portion is approximately 1.4 times wider in its ungathered configuration than in its gathered configuration, while the lower edge of the core portion is approximately 1.10 times wider in its ungathered configuration than in its gathered configuration.

4. The comforter of claim 1, wherein the core portion is up to 20 inches greater in width than the top of the mattress on which it is used.

5. The comforter of claim 1, including side border portions which are sewn to the side edges of the core portion and to ends of the head and foot border portions.

6. The comforter of claim 5, wherein the head and foot border portions are each approximately nine inches wide, and the side border portions are each approximately 15 inches wide.

7. The process of making a comforter, comprising the steps of:

making a core portion of the comforter which includes upper and lower fabric layers of substantially the same size with lines of stitching connecting the upper and lower layers and with filling material positioned within the volumes of the core portion as defined by the lines of stitching, wherein the lines of stitching and the filling are accomplished prior to attachment of a head border portion or after said attachment; and attaching a head border portion to a top edge of the core portion, which includes the top edges of both the upper and lower fabric layers, wherein the top edge of the core portion is gathered prior to attaching the head border portion, wherein the top edge of the core portion is approximately 20-75% wider ungathered than when gathered and attached to the core portion and wherein the head border portion is filled with filling material prior to or following attachment thereof to the core portion.

8. The process of claim 7, including the step of attaching a foot border portion to a lower edge of the core portion, wherein the lower edge of the core portion is gathered prior to attaching the foot border portion, wherein the lower edge of the core portion is approximately 0-50% wider ungathered than when gathered and attached to the core portion and wherein the foot border portion is filled with filling material prior to or following attachment thereof to the core portion.

9. The process of claim 8, wherein the top edge of the core portion is approximately 1.45 times wider ungathered than when gathered and attached to the core portion, and wherein the lower edge of the core portion is approximately 1.1 times wider ungathered than when gathered and attached to the core portion.

10. The process of claim 8, including the step of attaching side border portions to side edges of the core portion and to opposing ends of the head and foot end border portions.

* * * * *